US006460844B1

(12) United States Patent
Clifford et al.

(10) Patent No.: US 6,460,844 B1
(45) Date of Patent: Oct. 8, 2002

(54) CUT SHEET STREAMER AND MERGER

(75) Inventors: John W. Clifford, Ashland; Steven P. Lewalski, Melrose; Matthew D. Bouche, Tyngsboro, all of MA (US); Bruce J. Taylor, Manchester, NH (US)

(73) Assignee: Roll Systems, Inc., Burlington, MA (US)

( * ) Notice: Subject to any disclaimer, the term of this patent is extended or adjusted under 35 U.S.C. 154(b) by 117 days.

(21) Appl. No.: 09/702,497

(22) Filed: Oct. 31, 2000

(51) Int. Cl.[7] ..... B65H 39/02

(52) U.S. Cl. ..... 271/9.13; 271/9.12; 271/251; 271/303; 271/197; 270/52.09; 270/58.01; 83/934

(58) Field of Search ..... 271/9.01, 9.1, 271/9.12, 9.13, 248, 250, 251, 303, 194, 197; 270/52.07, 52.09, 52.12, 58.01; 83/934; 242/615.21; 225/99

(56) References Cited

U.S. PATENT DOCUMENTS

| | | | | |
|---|---|---|---|---|
| 4,770,407 A | * | 9/1988 | Nail | 271/151 |
| 5,000,394 A | | 3/1991 | Wales et al. | |
| 5,280,903 A | | 1/1994 | Herrick, Jr. | |
| 5,284,335 A | | 2/1994 | Golicz | |
| 5,366,212 A | | 11/1994 | Crowley et al. | |
| 5,494,272 A | | 2/1996 | Golicz | |
| 5,538,171 A | | 7/1996 | Crowley | |
| 5,540,370 A | * | 7/1996 | Ring | 225/100 |
| 5,628,574 A | | 5/1997 | Crowley | |
| 5,692,746 A | | 12/1997 | Herrick, Jr. | |
| 5,751,298 A | | 5/1998 | Crowley | |
| 6,155,562 A | * | 12/2000 | Pollock et al. | 271/279 |
| 6,341,773 B1 | * | 1/2002 | Aprato et al. | 270/52.01 |

FOREIGN PATENT DOCUMENTS

| | | | | |
|---|---|---|---|---|
| DE | 19819736 C1 | * | 9/1999 | B65H/3/12 |
| DE | 19940406 C1 | * | 10/2000 | B65H/5/24 |
| DE | 19935186 C1 | * | 11/2000 | B65H/29/66 |

* cited by examiner

*Primary Examiner*—Christopher P. Ellis
*Assistant Examiner*—Patrick Mackey
(74) *Attorney, Agent, or Firm*—Cesari and McKenna, LLP; William A. Loginov, Esq.

(57) ABSTRACT

An apparatus for selectively streaming and merging side-by-side sheets is provided. In general, sheets enter in a side-by-side orientation onto an input feed surface and are directed selectively upwardly or downwardly onto overlying upper and lower feed surfaces by a diverter assembly having two diverter sides. The diverter sides can be independently moved to direct sheets upwardly or downwardly. The upper feed surface and lower feed surface have opposing edge guides. The upper feed surface and lower feed surface can be moved with respect to each other so that the edge guides are placed one sheet width apart or more than two sheet widths apart. By orienting the two diverter halves, and setting the desired distance between the upper and lower edge guides, sheets can pass along each of the upper and lower surfaces in a side-by-side streamed or over-lapping merge orientation. Sheets pass out of each of the upper and lower feed surfaces onto a common output surface through an output ramp at which time they are either side-by-side streamed or merged. Each edge guide can include an offset actuator that moves at selected times to provide an offset to selected sheets as they enter the output feed ramp. Sheets can be derived from a wide web that is slit and cut as it enters the input feed unit.

24 Claims, 14 Drawing Sheets

CUT SHEET STREAMER AND MERGER

BACKGROUND OF THE INVENTION

1. Field of the Invention

This invention relates to web and sheet handling devices and more particularly to devices for selectively streaming and merging side-by-side sheets in a stream.

2. Background Information

In high-volume electronic printing applications it is often desirable to produce side-by-side images on a wide continuous web. In this manner, each printing operation by, for example, a rotating image transfer drum, produces two pages rather than one. The side-by-side images on the wide web can be the same, representing two copies of the same job; can be consecutive pages in the same job; or can be different jobs or sections of a job. At some time during the printing process, a downstream cutter and slitter forms each image into a separate page. Where the images represent consecutive pages in the same job, a merger places the images over each other. Conversely, where the images represent different jobs or separated sections, the cut and slit sheets are carried downstream in separate streams to a stacker or other post-production device. It is common for sheets to be cut after two or more ribbons of web are slit and merged over each other, in the form of a slit and merged web. In this manner, two or more overlapping sheets are cut from the corresponding merged ribbons. The slit and merge technique has limitations in speed, setup and functional versatility. The resulting output sheets must often be handled according to a very specific arrangement, and existing devices do not accommodate many different orientations or sizes.

Accordingly, it is an object of this invention to provide a versatile sheet handling device that enables selective feeding of either merged or side-by-side streams of sheets from an upstream source to a downstream post-processing device, such as a stacker. The merge and stream-handling device should operate at reasonably high speed and accommodate a variety of lengths and sizes of sheets with a high degree of accuracy in registration in both a side-by-side and upstream-to-downstream direction. The device should also enable selective offset of sheets in either a streaming or merged arrangement.

SUMMARY OF THE INVENTION

This invention overcomes the disadvantages of the prior art by providing a device for selectively merging or streaming side-by-side fed sheets using an upper and lower feed surface each of which includes an edge guide on an opposing side-by-side edge. Each of the feed surfaces can be moved in a widthwise (side-by-side) direction with respect to the other to thereby relocate its associated edge guide. As sheets pass over each of the upper and lower feed surface, a set of vacuum drive belts bias fed sheets against the respective edge guide. As respective edge guide. By selectively aligning the edge guides, and directing the sheets to either of the upper or lower feed surfaces, the sheets can be selectively aligned over each other for merged output or maintained in a side-by-side relationship or they do not overlap. A diverter assembly having a pair of side-by-side diverter halves is located adjacent to and input surface. The diverter halves can be moved separately to direct each of side-by-side slit sheets to either of the upper or lower feed surface. An output ramp assembly directs sheets from each of the upper and lower feed surfaces back onto a single feed surface for delivery to a post-production device. At this location, the sheets are delivered into two side-by-side streams, or overlying each other in a merged arrangement. Each feed surface is wide enough so that at an appropriate widthwise position. It can receive sheets from either of the two side-by-side input diverter halves. This enables the sheets to be selectively maintained in side-by-side streams, or to be passed crosswise into overlapping (merged) positions.

According to preferred embodiment the edge guide of each of the upper and lower feed surface includes actuators to move it in a widthwise direction so as to enable offset of selected sheets passing there over. In addition, an upstream cutter and slitter can be located adjacent to the input feed surface to create side-by-side cut sheets from a continuous web. The input feed surface can include a set of vacuum belts that are angled outwardly from each other in a downstream direction to provide a separation between slit sheets before they enter the diverter assembly. At least one of the feed surfaces can include a removable stream plate that covers a plurality of angled feed belts on the feed surface when sheets are driven in a side-by-side stream relationship so that excessive angular force is not applied to the streamed sheets. Finally, each of the input, upper and lower feed surfaces can be mounted on a box structure having fans mounted thereon for driving air flow through ports around respective vacuum belts to maintain frictional adhesion of sheets against the vacuum belts, while allowing widthwise translation against respective edge guides. The upper and lower feed surfaces can also include a removable cover that maintains the sheets in close proximity to the belts as they pass along the respective feed surface.

BRIEF DESCRIPTION OF THE DRAWINGS

The foregoing and other objects and advantages of the invention will become clearer with reference to the following detailed description as illustrated by the drawings in which.

DETAILED DESCRIPTION OF AN ILLUSTRATIVE EMBODIMENT

Figure 1:
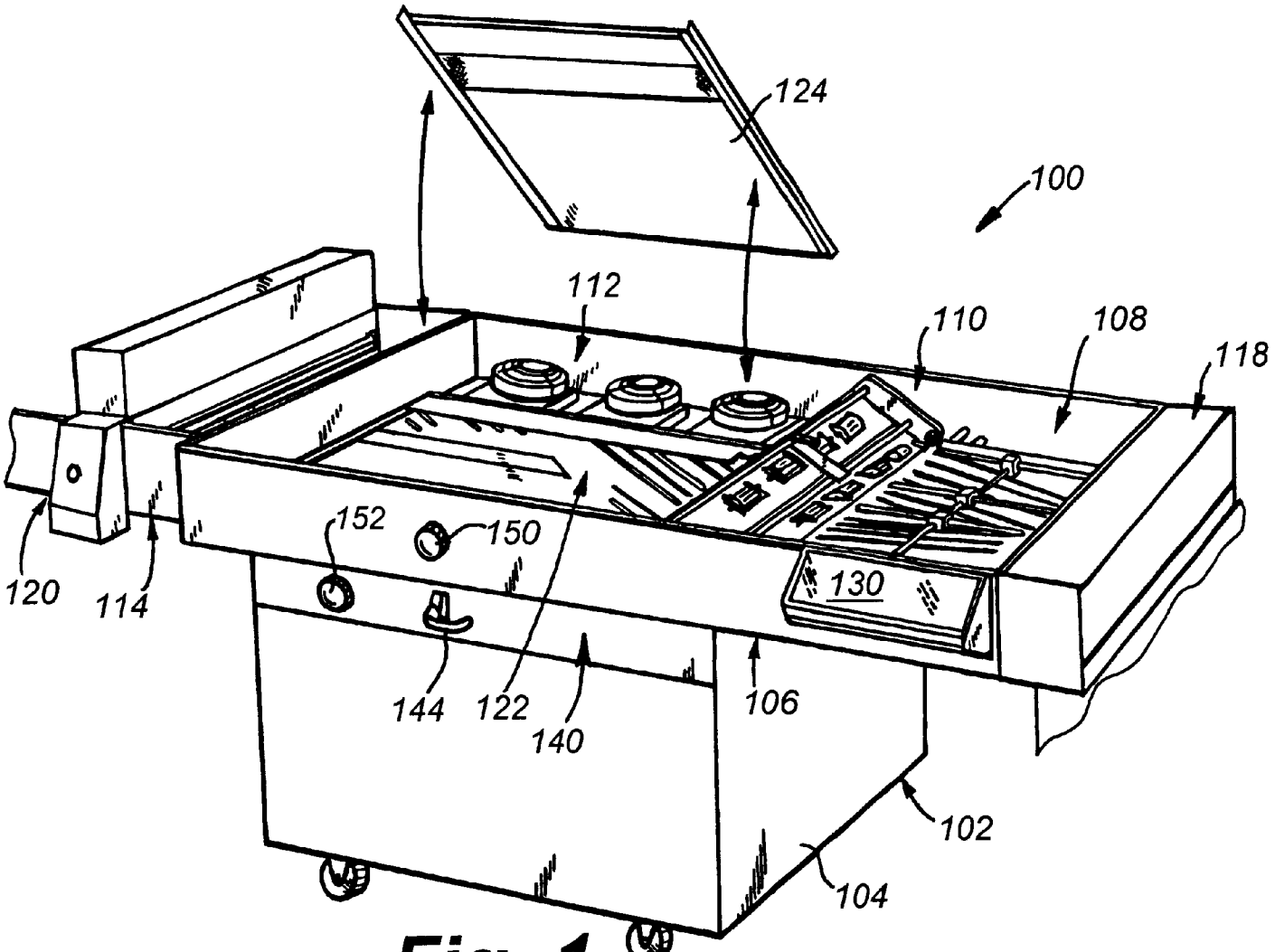
FIG. 1 is a perspective view of a device for handling sheets in either a side-by-side streaming or merged relationship according to this invention.

FIG. 1 shows a device 100 for selectively streaming or merging side-by-side sheets according to a preferred embodiment of this invention. The device includes a housing 102 having a portable base 104 and an upper support structure 106. Within the support structure is housed an input feed unit 108 a diverter 110, an upper and lower feed surface assembly 112 and an output ramp assembly 114. A control panel 120 is provided for operating various device functions and power supplies. Upstream of the input feed surface 108 is a cutter assembly 118. This is a separate component that is optional. The cutter 118 separates sheets from the tail end of a continuous web (not shown). Adjacent the cutter is also provided a slitter that divides the continuous web (or previously cut sheets) into side-by-side sections. The slitter is shown and described further below. Downstream for the output ramp assembly 114 is the input section of the post production device 120. The post production device can comprise any appropriate sheet handling device such as a stacker, folder or further printer. The upper and lower feed surface assembly 112 includes an upper feed surface 122 covered by a removable cover 124. The cover 124 is typically hinged for ease of movement, but is shown herein removed for clarity. An outer cover can also be provided to the support surface 106. This is removed for clarity. A control panel 130 is used for operating various power supplies, drive motors, suction fans and other components of the device.

Figure 2:
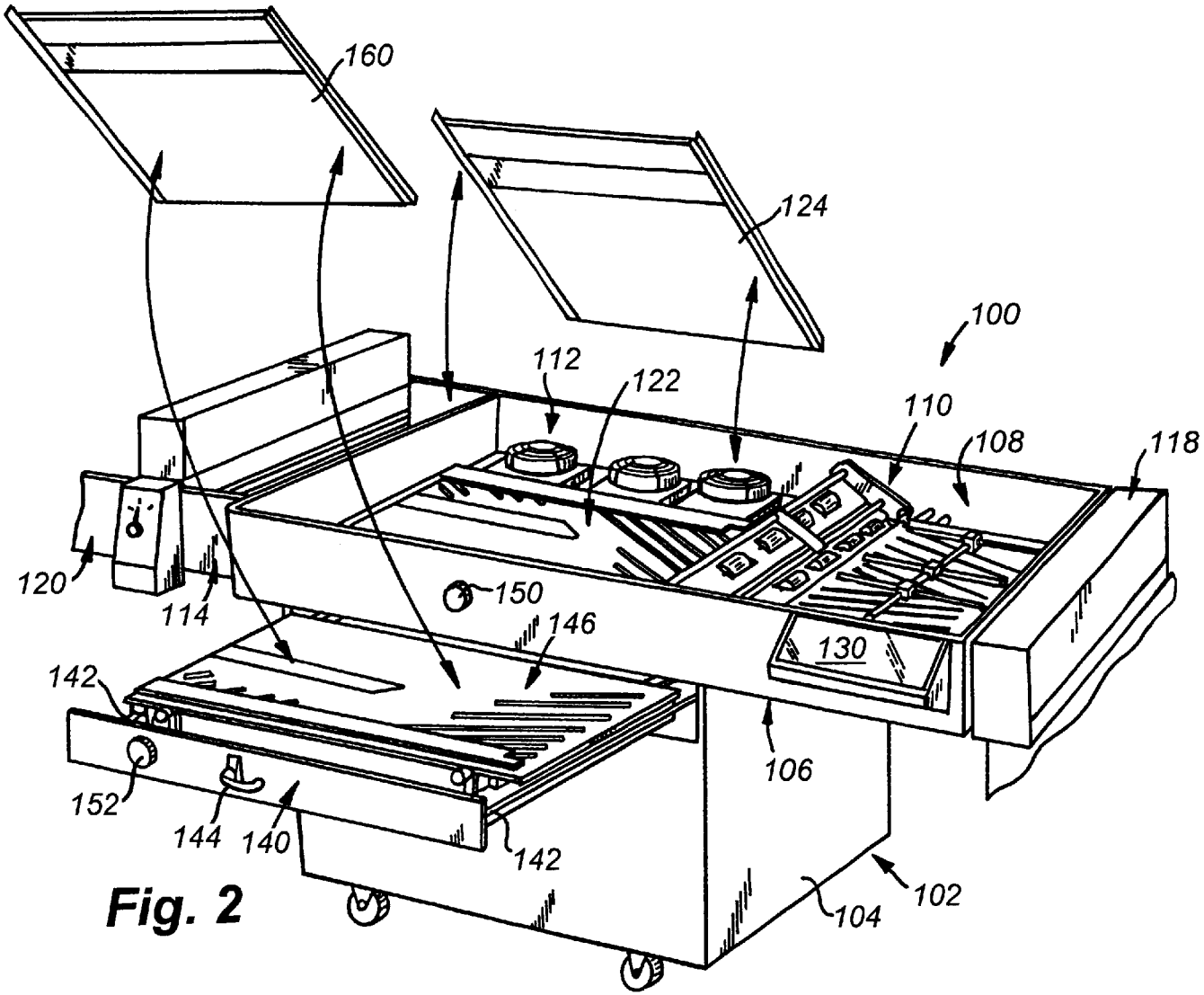
FIG. 2 is a perspective view of the device of FIG. 1 showing the lower feed surface exposed.

The device 100 is shown in further detail in FIG. 2. The upper and lower feed surface assembly 112 includes a lower feed surface drawer 140 supported by full extension-slides 142 (shown in phantom). The lower drawer assembly 140 includes a locking handle 144 and that, when locked, maintains the lower feed surface 146 in a predetermined position beneath the upper feed surface 122. As described further below, the upper feed surface 122 and lower feed surface 146 are moveable in a widthwise direction by rotating the respective adjustment knobs 150 and 152. The lower feed surface 146 is covered by a removable cover 160. The removable cover 160 is, likewise, hinged to the feed surface 146.

Figure 3:
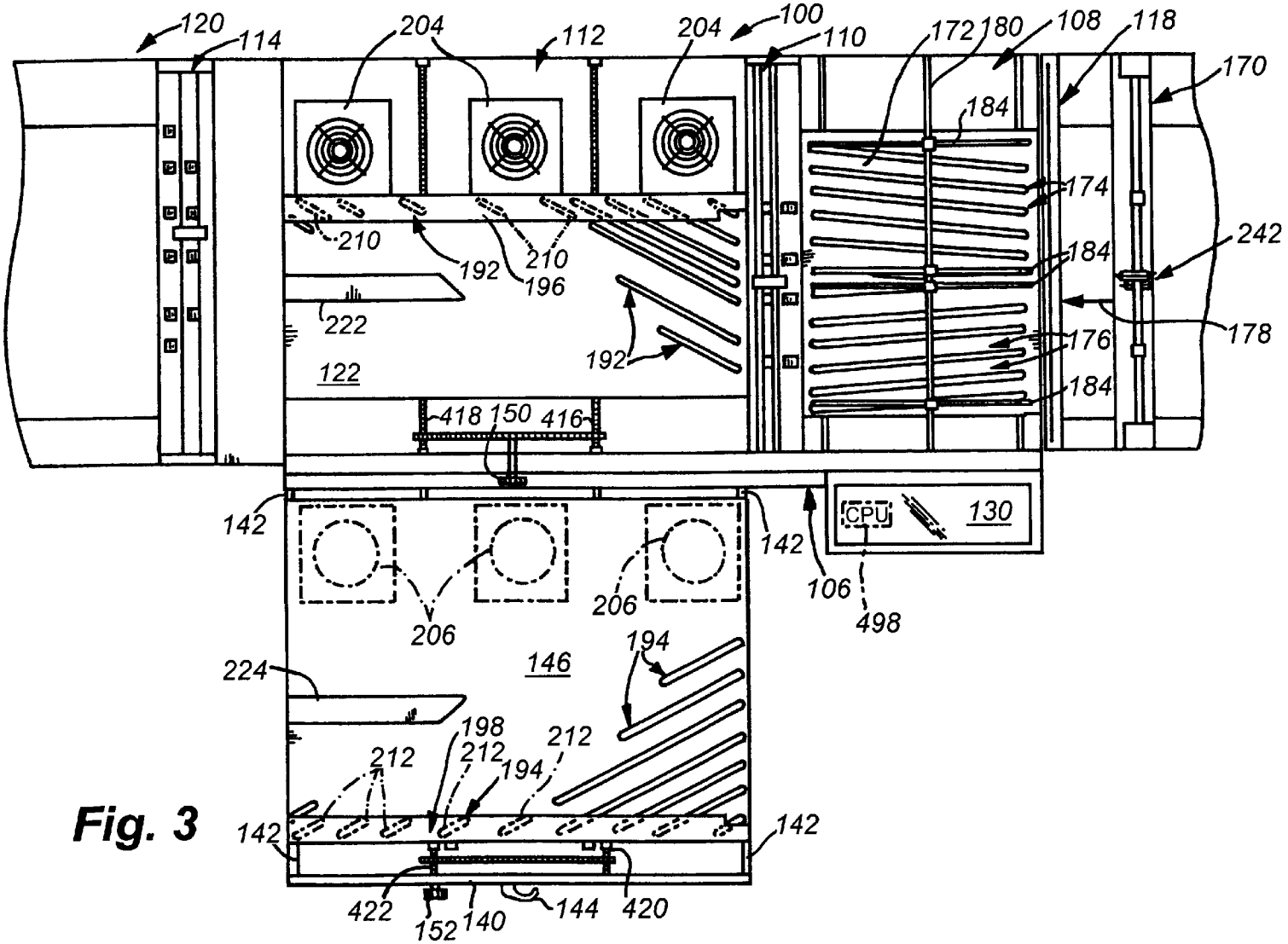
FIG. 3 is a plan view of the device of FIG. 1 showing the lower feed surface in an opened position.
Figure 4:
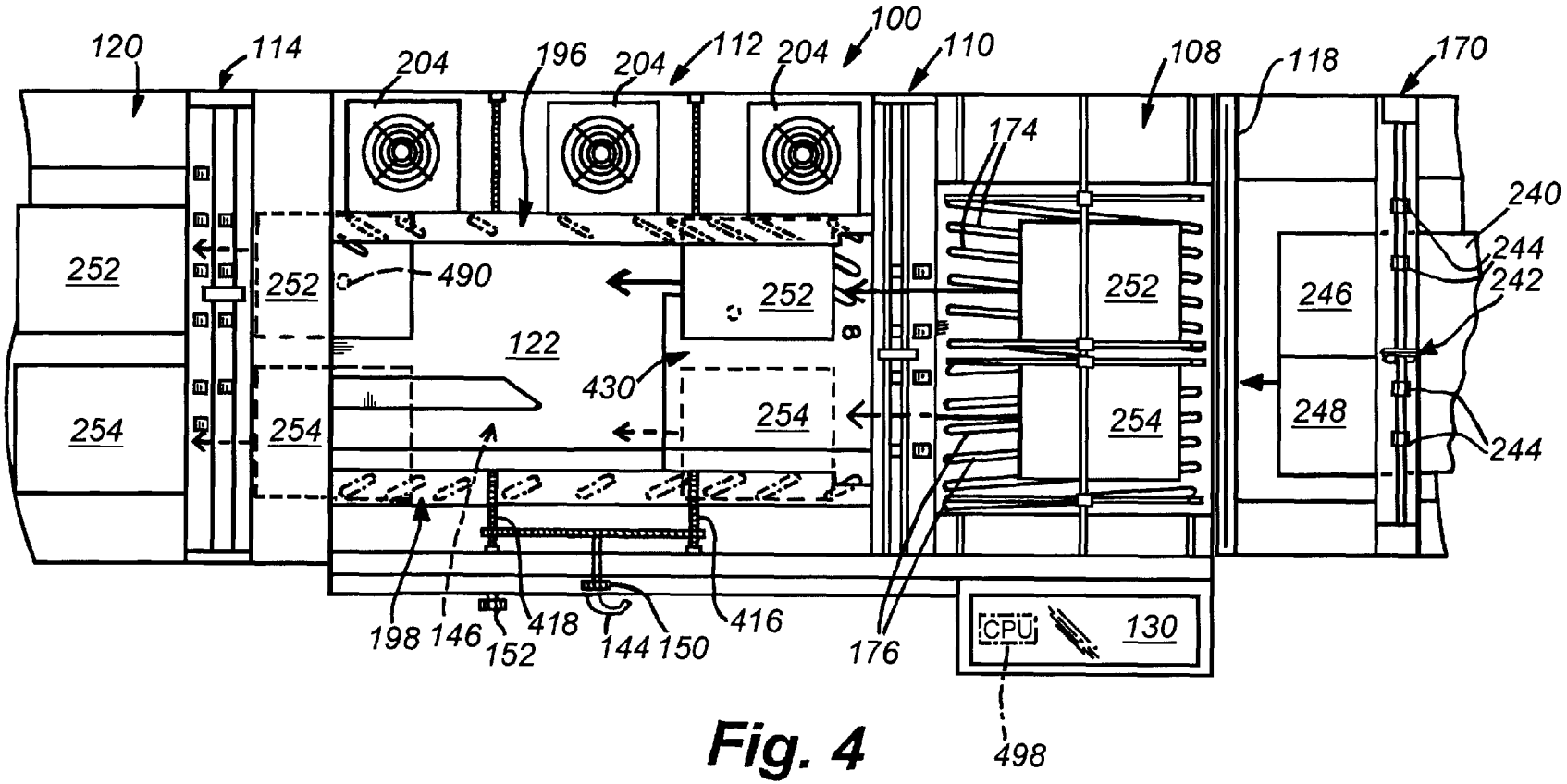
FIG. 4 is a plan view of the device of FIG. 1 configured to feed to side-by-side streams of sheets.

FIG. 3 shows a plan view of the device as depicted in FIG. 2 with open lower feed drawer. The slitter assembly 170 is depicted therein. The input feed assembly 108 includes a corresponding feed surface 172 having two sets of angled feed belts 174 and 176. Each belt set 174 and 176 is angled at approximately 5° outwardly with respect to the upstream to downstream direction (arrow 178). Each belt set is particularly angled outwardly away from the center therebetween along the downstream direction. The outward angle causes sheets on each of the belt sets 174, 176 to separate slightly from each other thereby preventing binding of sheets on each other, and to ensure each of the sheets is fully registered on a desired half of the diverter assembly 110 (described further below). The belts 174 and 176 reside in slots that enable air to pass therethrough. The vacuum drive belts used throughout this device comprise circular-cross section elastomeric belts (typically, circular-cross section polyurethane) that have contact surfaces raised slightly above the plane of the feed surface 172. Suction caused by fans (not shown) beneath the surface 172 of the input feed unit 108 generates a slight downward vacuum suction that maintains sheets frictionally against the belts 174, 176 as they move therealong. Overlying the belts 174 and 176 is a support bar 180 that carries at least four adjustable hold-down bars 184 that are suspended at a gap of approximately ¼–½ inch above the feed surface 172 in order to prevent unwanted fly-up of input sheets as they pass into the diverter assembly 110.

Figure 13:
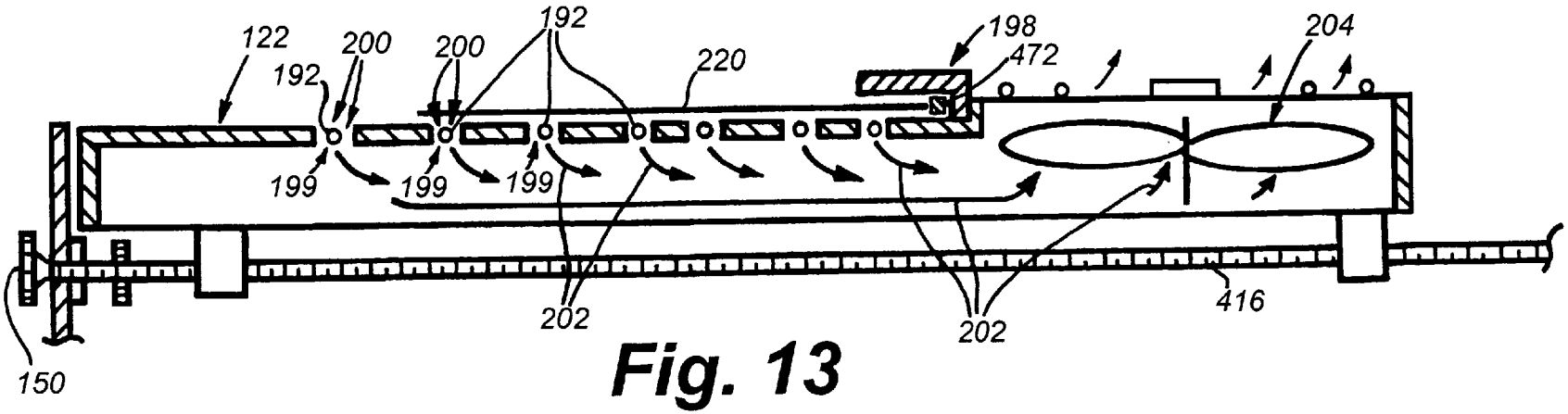
FIG. 13 is a cross section of the upper feed surface and associated box detailing the passage of suction air therethrough.

The upper feed surface 122 and lower feed surface 146 each include a set of parallel belts 192 and 194 angled approximately 20° with respect to the downstream direction in each of opposing directions. In other words the upper belts 194 are angle to the right, while the lower belts are angled to the left—as taken along the downstream direction. A respective edge guide 196 and 198 is provided along an opposing edge of each feed surface 122 and 146. The belts are angled so that sheets fed from the input feed unit 108, through the diverter 110, are directed both downstream and against the respective edge guide 196 and 198. Referring also to FIG. 13, the belts 192 and 194 reside within respective grooves 199 within each feed surface. The grooves are wide enough to define a clearance 200 around each side of the belt so that air is biased therethrough (see arrows 202) by the electric fans 204 and 206 the upper feed surface fans 204 expel suction air upwardly while the lower feed surface fans 206 expel suction air downwardly. The underlying housing of each of the upper feed surface and the lower feed surface is sealed for the most part, except for the ports of the fans mounted thereon. The particular exhaust porting of the upper feed surface fans 204 is upward, and the exhaust porting of the lower feed surface fans 206 is, conversely, downward. This porting arrangement facilitates the stacking of the units in a closed position to be described below. Based upon the suction, a sheet 220 is maintained frictionally against the belts, but with the ability to slide down-stream against the angled (with respect to upstream-downstream and lateral directions) force vector generated by the belts. In other words, once each sheet contacts the edge guide with its respective guide rail, the guide rail resists the continuous lateral force component exerted by the angled belts, and the vacuum enables slippage of the sheet with respect to forces resolved in the lateral direction—so that only the force component directing the sheet downstream acts upon it. As such, the sheets are moved downstream in continuous, forcible registration with the edge guide, but without buckling relative to the edge guide. To further prevent buckling, the downstream-located belts 210 and 212 extend outwardly from each edge guide no more than approximately two or three inches. Thus, only a narrow portion of the full width of the sheet is engaged by the belts as it passes down the edge guide into the output ramp assembly. The small width is capable of resisting buckling from the lateral force component due to the inherent beam strength of the narrow width.

Each feed surface 122 and 146 also includes a slightly raised support finger plate 222 and 224. Each support finger plate 222, 224 assists in guiding sheets into the output ramp assembly 114, as described further below. The support finger plates can include a slightly rippled or diamond-plate surface, as can the stream plates. The arrangement angled belts 192 and 194, located adjacent to the input feed unit 108 extend across the majority of the width of each respective feed surface 122 and 146. This enables input sheets to be translated fully from one side of the feed surface, laterally to the other side of the feed surface, adjacent the edge guide. This process is described in further detail below. In certain applications, the belts furthest from the edge guide are covered so that they do not exert unwanted forces on sheets that are already close to the edge guide. This is also described further below.

FIGS. 4–7 details the operation of the device in a variety of different feed modes. In general, the device makes possible the feeding and formation of merged or side-by-side sheet streams from a single wide web 240 or from a pair of side-by-side cut sheet sources. The slitter module 170 includes a pair of slitter disks 242 and associated driving pinch rollers 244 that generate two slit ribbons 246 and 248 of web from the single wide web 240. Note, while the source used herein is a single slit web (240), it is expressly contemplated that the source can be one or more streamed groups of precut, side-by-side sheets fed by appropriate input conveyers to the input feed unit 108. In the present embodiment, the cutter assembly 118 cuts of leading edges of the ribbons 246 and 248 to create resulting right and left sheets 252 and 254 on the input unit 108. Based upon the configuration of the diverter assembly 110, the sheets 252 and 254 are selectively driven to the upper feed surface 122 or the lower feed surface 146. This determines the final output configuration of the sheets at the output section, which leads to a desired post-production device 120. The various modes of feeding provided by the unit are made possible by a bi-level feed surface structure. In particular, the upper feed surface biases sheets to a right-oriented edge guide 196, while the bottom feed surface 146 biases sheets to a left-oriented edge guide 198. Even when sheets are presented to an opposing width-wise side of the particular feed surface, they travel at an angle toward the respective edge guide. The direction of sheets to the upper and lower surface is controlled by a two-piece diverter assembly 110 according to this invention. Before describing the various feeding modes of the device 100, a further discussion of specific device components that facilitate the feeding function is now provided.

Figure 8:
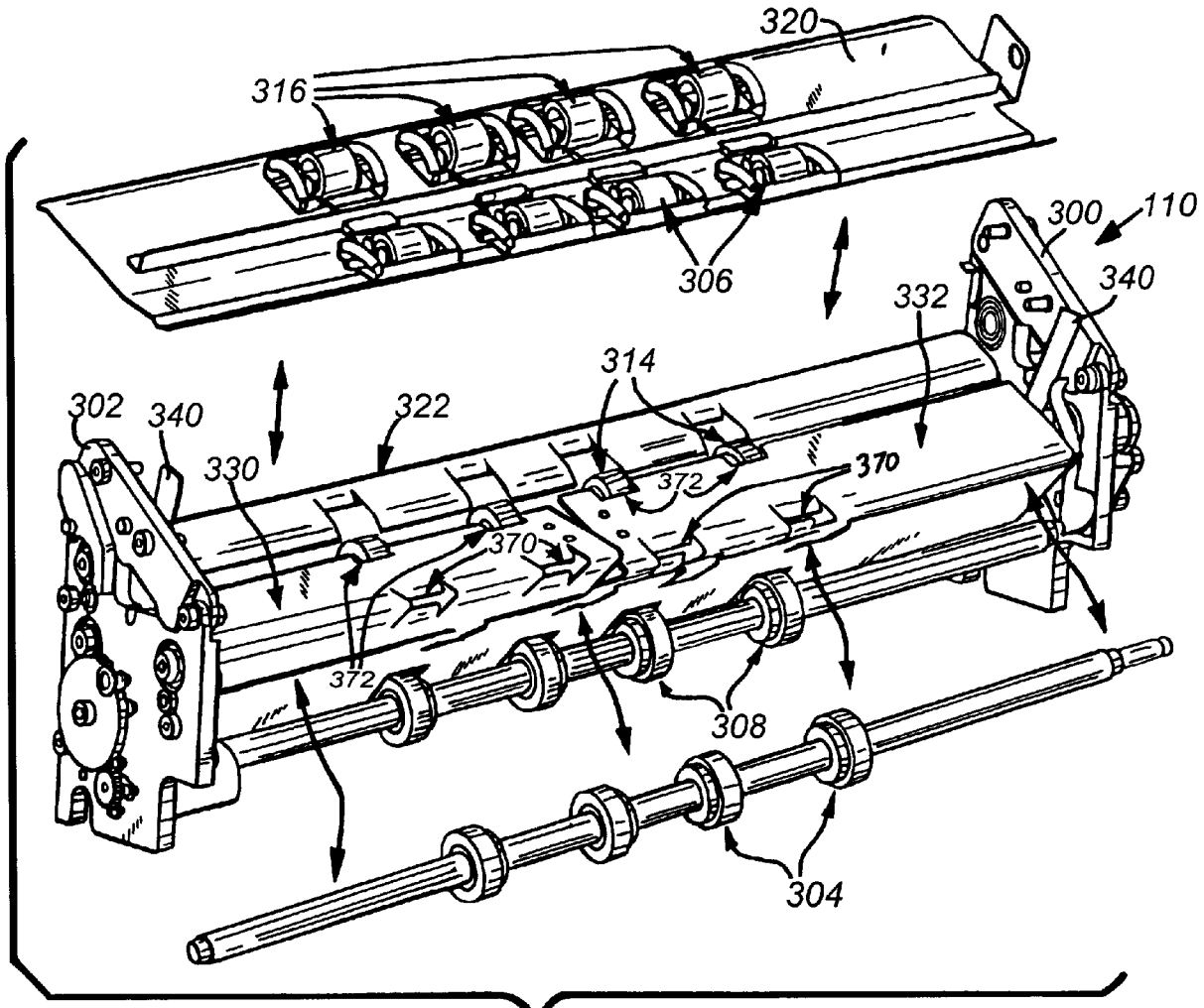
FIG. 8 is an exploded view of the diverter assembly at the input end of the upper and lower feed surfaces according to a preferred embodiment.
Figure 9:
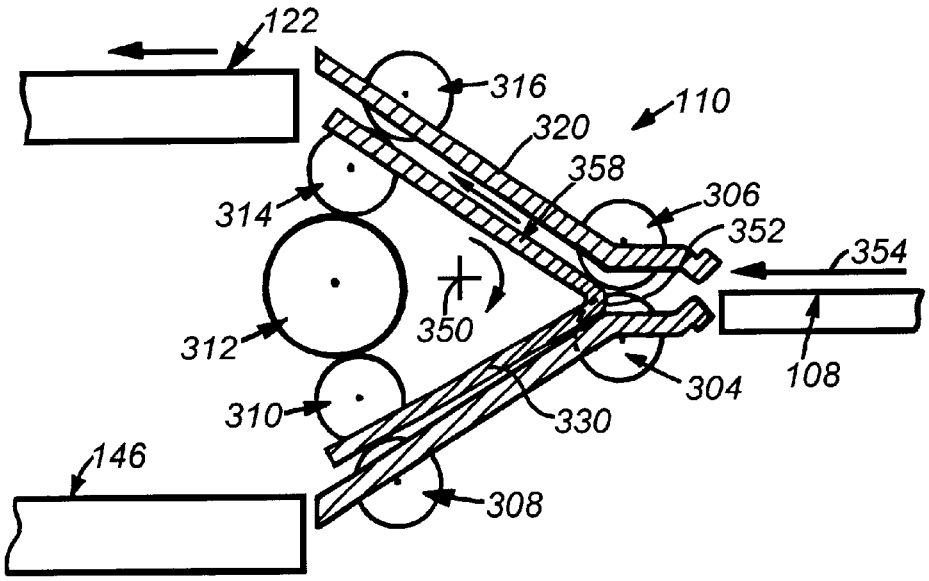
FIG. 9 is a somewhat schematic cross section of the diverter of FIG. 8 directing a sheet onto the upper feed surface.
Figure 10:
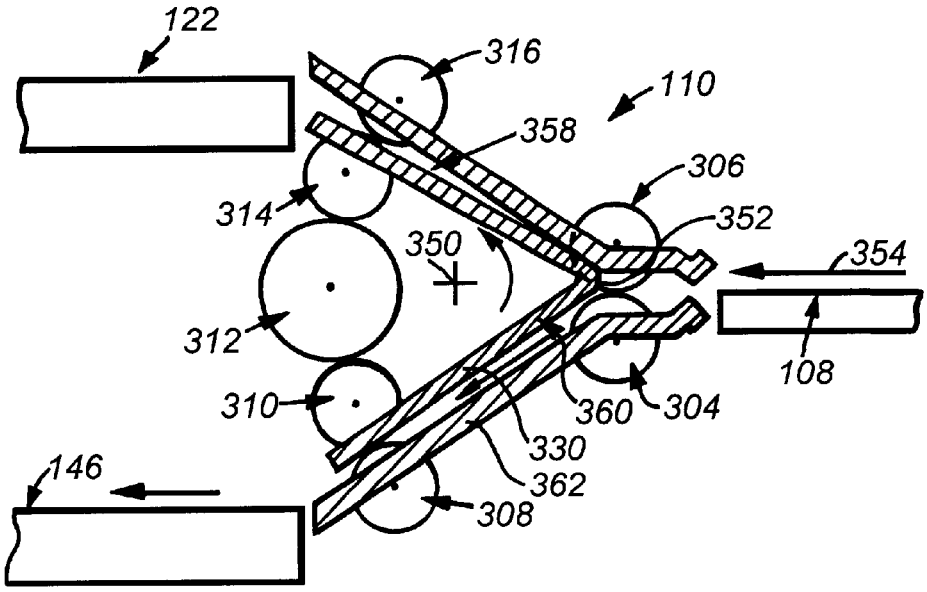
FIG. 10 is a somewhat schematic cross section of the diverter of FIG. 8 directing a sheet onto the lower feed surface.

With reference to FIGS. 8–10, the diverter assembly is shown in further detail. The diverter assembly 110 is a powered feed unit driven by an independent motor or by central drive motor through an appropriate drive interconnection (not shown). The diverter assembly 110 includes a pair of side frame plates 300 and 302 that support a multiplicity of drive roller assemblies 304, 306, 308, 310, 312, 314 and 316. Each of the drive roller assemblies comprise a plurality of elastomeric rollers mounted on a common shaft or axis. The number of rollers (typically four) is sufficient to provide each input sheet in the side-by-side pair with two spaced-apart engaging rollers. The roller assemblies 306 and 316 are part of an upper guide plate 320 that can be pivoted toward and away from the central diverter section 322. The rollers in the upper plate are typically free-wheeling and mounted on a plurality of independent shafts. The input nip rollers 304 and 306 receive sheets from the input feed surface 108. Note that nip rollers 304 are driven while the upper guide plate rollers follow. The nip rollers 304 and 306 direct sheets into either of a pair of diverter wedges 330 or 332. The wedges can be located respectively in either an upwardly oriented or downwardly oriented position.

As illustrated in FIG. 8, the diverter wedge 330 is located in an upwardly oriented position, while the diverter wedge 332 is located in a downwardly oriented position. Control levers 340 that project outwardly from the plate 320 enable the wedges 330, 332 to be independently manipulated. It is contemplated according to one embodiment that the wedges can be manipulated separately so that either, or a combination of both wedges can be located in an upward or downward orientation.

As further illustrated in FIG. 9, which details a cross section through the wedge 330 when the wedge is located in a downward position, it is pivoted about an offset center point 350 so as to position the wedge apex 352 below the path of travel (arrow 354) of sheets into the diverter assembly 110. As such, entering sheets are engaged by the input nip rollers 304 and 306 and directed along the upper surface 358 of the wedge 330 upwardly onto the upper feed surface 122. This is shown by the arrow path therethrough. The main diverter drive roller assembly 312 rotationally engages, and drives, both the upper nip rollers 314 and 316, and the lower nip rollers 310 and 308 to direct sheets onto a selected, respective feed surface.

As illustrated further in FIG. 10, when the wedge 330 is pivoted about the offset pivot point 350 into an upward orientation, the apex 352 is moved so as to direct sheets onto the lower feed path, which is bounded by the bottom face 360 of the wedge 330. The lower guide plate 362 sandwiches sheets relative to the wedge bottom face as they are received and past along, by the lower nip rollers 308 and 310. The sheet is delivered onto the lower feed surface 146. Each wedge includes a plurality of apex recesses 370 that enable the apex 352 to move through a portion of the circumference of the roller assemblies 304 and 306. This ensures that sheets will contact an appropriate feed surface 358 or 360 without binding on the apex 352. Note that the wedges 330, 332 also include rear roller notches 372 to enable the wedge top and bottom surfaces to extend to the respective feed surfaces 122, 146, while providing clearance around the downstream nip roller pairs 314, 316, 308 and 310 as the wedges pivot between their upward and downward positions.

Figure 11:
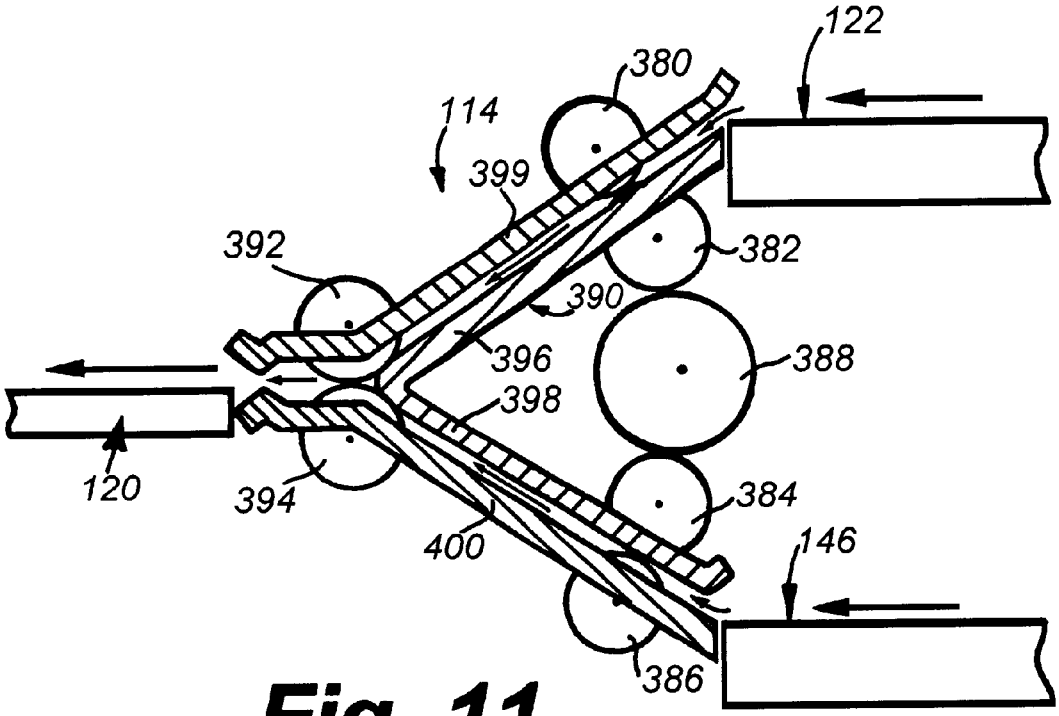
FIG. 11 is a somewhat schematic cross section of the output ramp directing sheets from each of the upper and lower feed surfaces onto an output feed surface.
Figure 12:
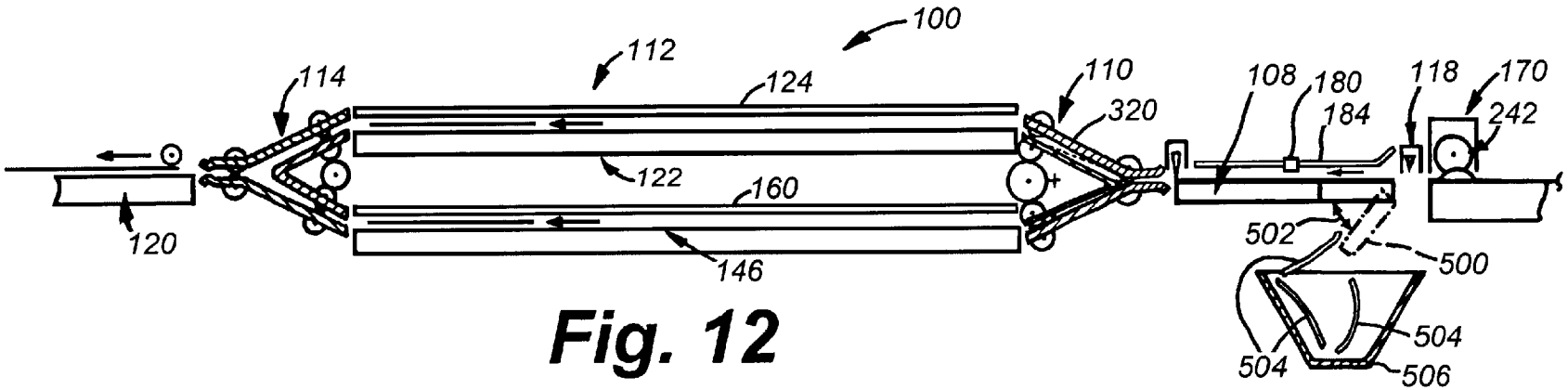
FIG. 12 is a somewhat schematic cross section of the overall feed path through the device.

Like the diverter assembly 110, the output ramp assembly 114 is arranged as a wedge structure for guiding sheets from each of the upper and lower feed surfaces 122, 146 onto a common post-production device input surface location 120. The output feed ramp 114 is detailed in FIG. 11. The output feed assembly includes a driven output roller set having upper nip rollers 380 and 382, lower nip rollers 384 and 386 and a central driving roller 388, that like the roller 312, engages and rotates the respective nip rollers 382 and 384. Sheets exiting either the upper feed surface 122 or lower feed surface 146 are directed down respective nip roller pairs along the inner wedge 390 to a central output roller pair 392 and 394, that are also driven. The wedge 390 includes an upper feed surface 396 and a lower feed surface 398. This wedge 390 is fixed, however, since both upper and lower sheets converge at the post-production output location 120. Corresponding upper and lower guide surfaces 399 and 400 are provided to maintain the sheets within the assembly 114. Note that FIG. 12 shows generally the feed path for exemplary sheets through various stations of the device 100 further reference shall be made to this path below.

Figure 14:
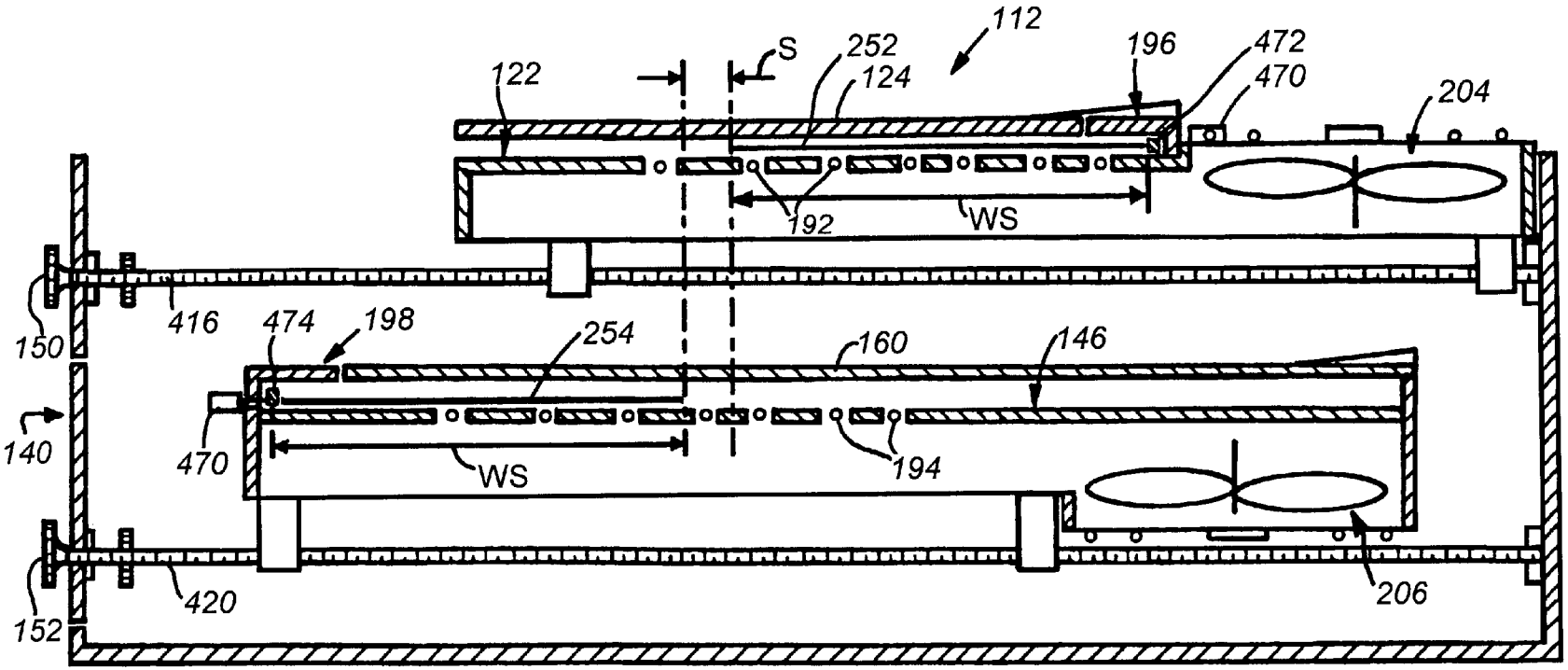
FIG. 14 is a cross section showing each of the upper and lower feed surfaces arranged to feed respective sheets in a stream relationship.

Having now described the various components of the device 100 in further detail, reference is again made to the various modes of operation of the device as shown in FIGS. 4–7. In a basic arrangement, shown in FIG. 4, sheets are slit and then driven into two side-by-side streams to the post production location 120. The right sheet 252 is separated from the ribbon half 246 by the cutter 118 while the left sheet 254 is simultaneously slit from its ribbon 248. The sheets pass along the input unit on the slightly diverging belts 174 and 176 into the diverters assembly 110. The respective right and left wedges of the diverter assembly have been oriented so that the right half directs the right sheet 252 onto the upper feed surface 122, while the left sheet 254 is directed by the left wedge onto the lower feed surface 146. The wedges are oriented so that their dividing line is between the two sheets 252 and 254. In this manner, each sheet is place squarely on an appropriate wedge, and travel in an appropriate direction. The upper feed surface 122 and lower feed surface 146 have been positioned so that the right sheet 252 passes onto the feed surface belts and engages the edge guide 196. Likewise, the left sheet 254 passes onto the lower feed surface 146 and directly engages the respective edge guide 198. Note that the adjustment knobs 150 and 152 (via chain drives) rotate respective jackscrews 416, 418 and 420, 422. Each feed surface 122 and 146 is supported on jackscrews and the rotation of the jackscrews causes a predetermined amount of lateral movement (in the widthwise direction) of each feed surface. Additional guide rails and associated bearing blocks can be used to support feed surfaces. The streaming arrangement of FIG. 4 corresponds with the cross section shown in FIG. 14. The upper feed surface 122 has been moved so that the edge guide 196 is placed at the far right. Likewise, the lower feed surface 146 is located moved so that its edge guide 198 is positioned laterally at the far left of the device housing. In other words the upper edge guide 196 and lower edge guide are spaced apart by two sheet widths WS or more. Accordingly, the upper sheet 252 is free of any overlap with the lower sheet 254. The sheets, accordingly, travel along their respective feed surfaces in a slightly separated (see spacing S on FIG. 14), side-by-side orientation. As noted above, a stream plate 430 is used to cover the outlining portions of the belts on each feed surface. In this manner, the sheets are not exposed to excessive rotational moments of force, as they are already roughly adjacent the desired edge guide.

Note that, while a standard sheet width WS is shown and used for both sheets (252, 254) in the side-by-side grouping, it is expressly contemplated that the width of sheets in the grouping can differ (for example a web can be slit off-center). Where uneven sheets are fed, they are centered with respect to the dividing line between diverter halves so that each sheet passes onto a discrete half. As used in this description the term "two sheet widths" shall be taken to define the combined sheet widths (larger and smaller—width), in a side-by-side grouping of sheets so that the sheets are spaced sufficiently to avoid overlap.

Figure 5:
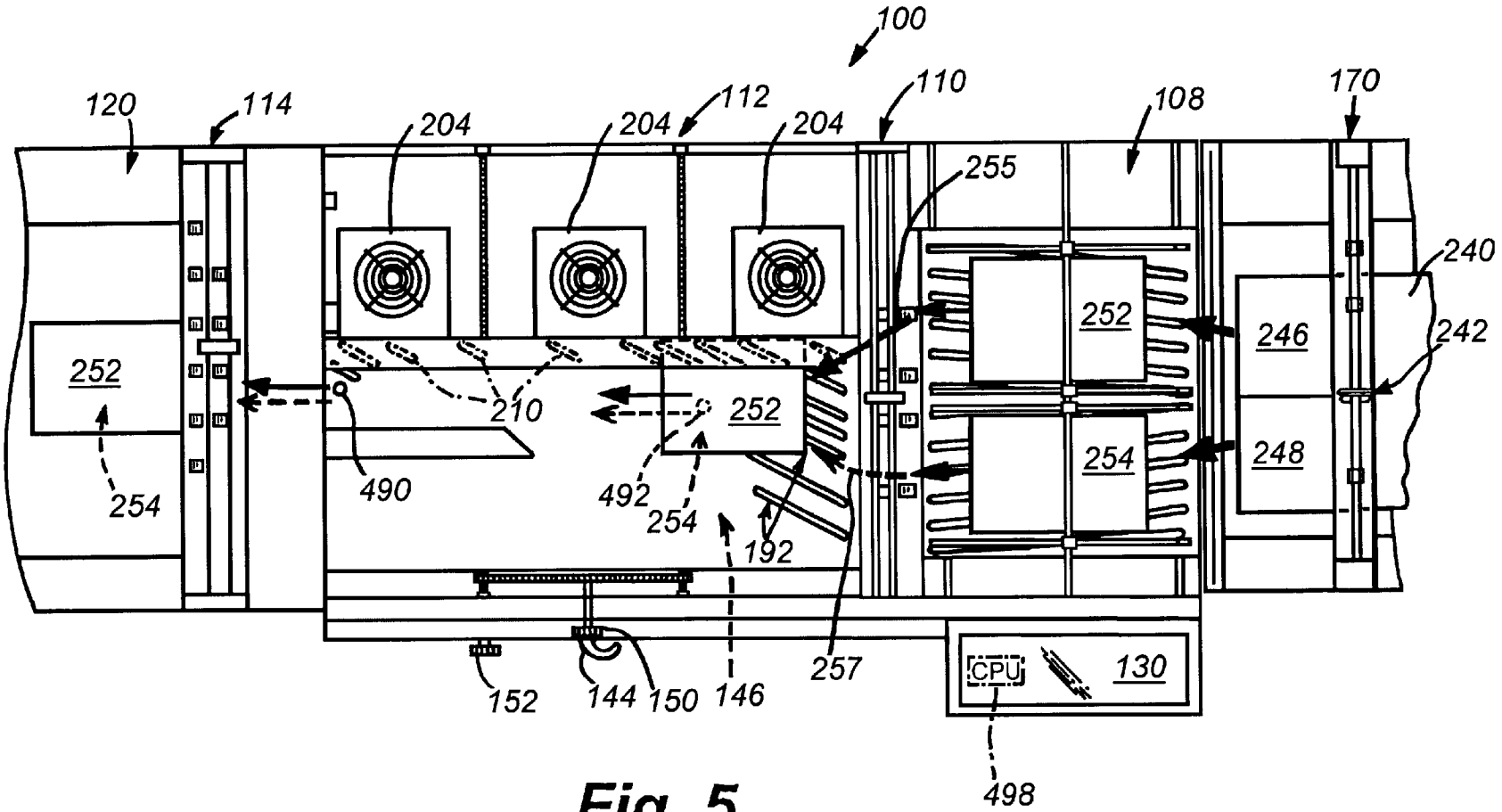
FIG. 5 is a plan view of the device configured to feed two sheets into a merged relationship.
Figure 15:
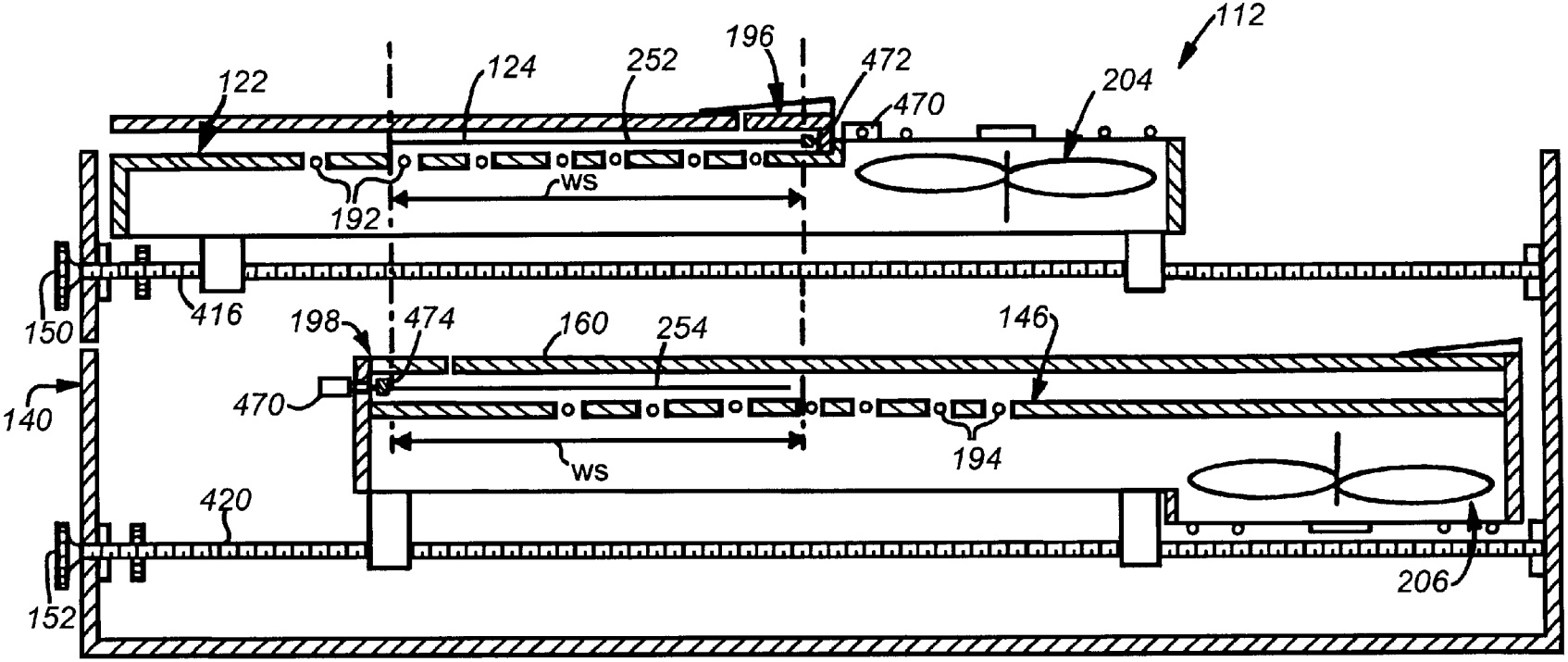
FIG. 15 is a cross section showing the upper and lower feed surfaces arranged to feed sheet in a merged relationship.

FIG. 5 details another feeding mode in which sheets are merged together into an overlying relationship is detailed. This arrangement is also shown in cross section in FIG. 15. The upper feed surface 122 and lower feed surface 146 are moved with respect to each other so that the upper edge guide 196 and lower edge guide 198 are separated by no more than the approximate width WS of a standard sheet (252 or 254). Accordingly, the sheets 252 and 254 overlie each other when they are each directed onto the respective feed surfaces 146 and 122. In this feeding mode, the right diverter wedge has been moved to direct the right sheet 252 onto the lower feed surface 146 while the left diverter wedge has been moved to direct the left sheet onto the upper feed surface 122. Since the upstream part of angled feed surface belts 192 and 194 both extend substantially across the width of their respective feed surface 122, 146, and the width is sufficient to enable a sheet to enter from an opposing side of the input feed unit 108, therefore the belts translate the sheets laterally (curved arrows 255, 257) across to the respective edge guide. Stream plates have been removed from both feed surfaces in this arrangement since the full width of the belts 192, 194 is utilized to enable sheets 152, 154 to traverse the width of their respective feed surface. The downstream-located feed surface belts 210 and 212 transport respective sheets 254, 252 once they have reached the edge guide 196, 198 until they reach the output ramp assembly 114. When the sheets 252 and 254 reach the output ramp assembly 114, they are in an overlying relationship, being merged they each pass down the respective upper and lower wedge surfaces 396 and 398 to come together at the nip rollers 392 and 394. Note that the apex of the output wedge is generally centered with respect to the output nip rollers 392, 394. The sheets pass in this merged relationship out of the nip rollers, and onward to the post-production device input surface 120.

Figure 6:
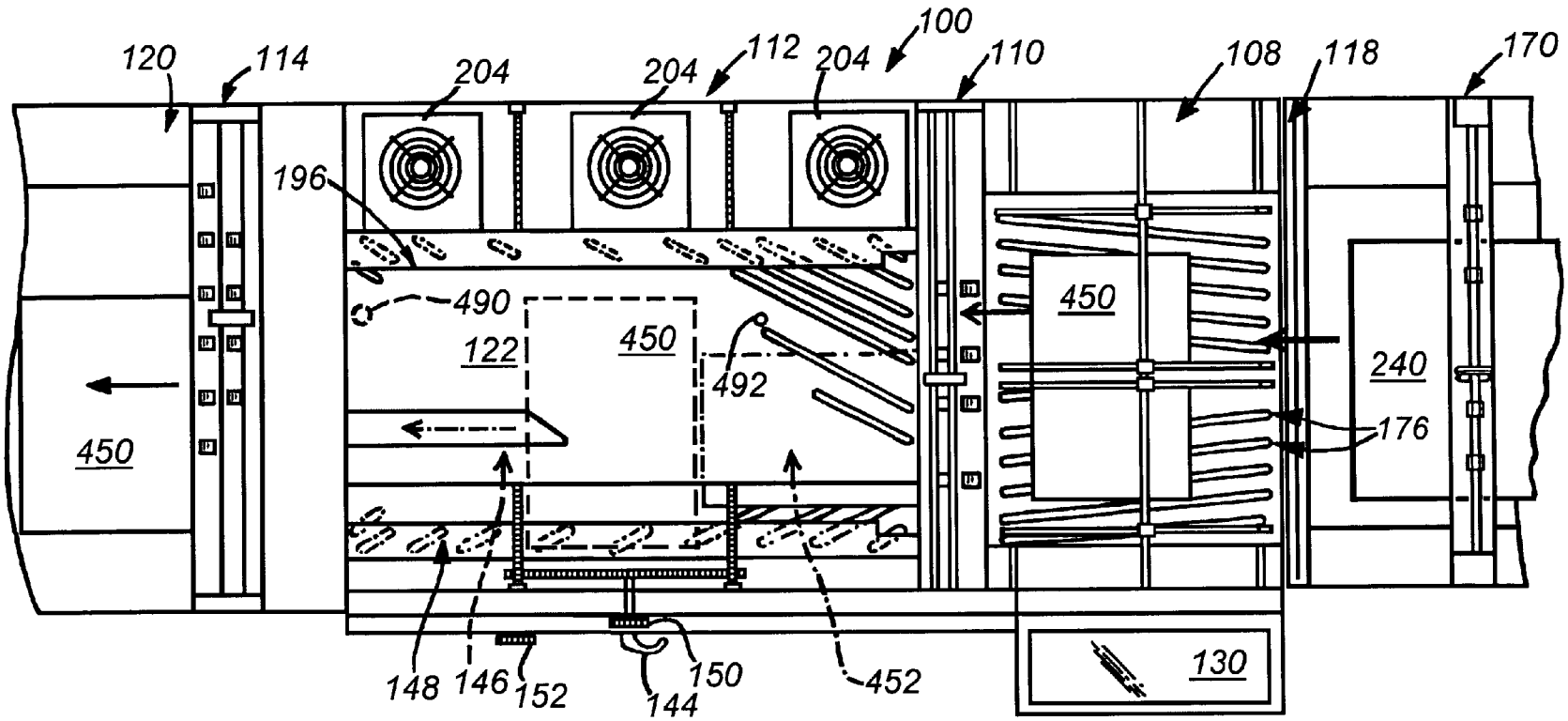
FIG. 6 is a plan view of the device configured to feed a full-width sheet free of slitting.

FIG. 6 shows another mode in which a single sheet (in this example, a wide sheet) 450 is transferred along a single feed surface 122 or 146. Note that the slitter disks have been removed from the slitter assembly 170 so that the full width of the web 240 passes into the cutter 118. In particular, the lower feed surface 146 is used to transport the sheet in this example. However, the upper feed surface 122 can also be used when sheet size and shape allow therefor. The sheet 450 is cut from the web 240 using the cutter 118, and passed onto the input feed surface 108. The oppositely angled input feed belts 174 and 176 provide with sufficient slippage, due to the vacuum, to prevent any tearing or rupture in the sheet 450 as it is passed downstream. The slight outwardly directed lateral force components, applied in an opposing directions by the belts 174 and 176, are generally cancelled-out, and the sheet proceeds in the downstream direction into the diverter assembly 110 without substantial drift to the left or right. The lower feed surface 146 has been oriented laterally using the adjustment jackscrews so that the lower edge guide 198 is roughly adjacent (slightly outward of) the left edge of the entering sheet 450. The sheet 450, whence, passes into engagement with the lower edge guide 198 and moves through the lower feed surface to exit from the output feed ramp 114. A lower stream plate 452 is provided over the outlying belts of the lower feed surface 146 to prevent undesired skew or rotation of the sheet 450 since it enters in near contact with the edge guide, and transverse movement of the sheet 450 across the feed surface 146 is not required.

Figure 7:
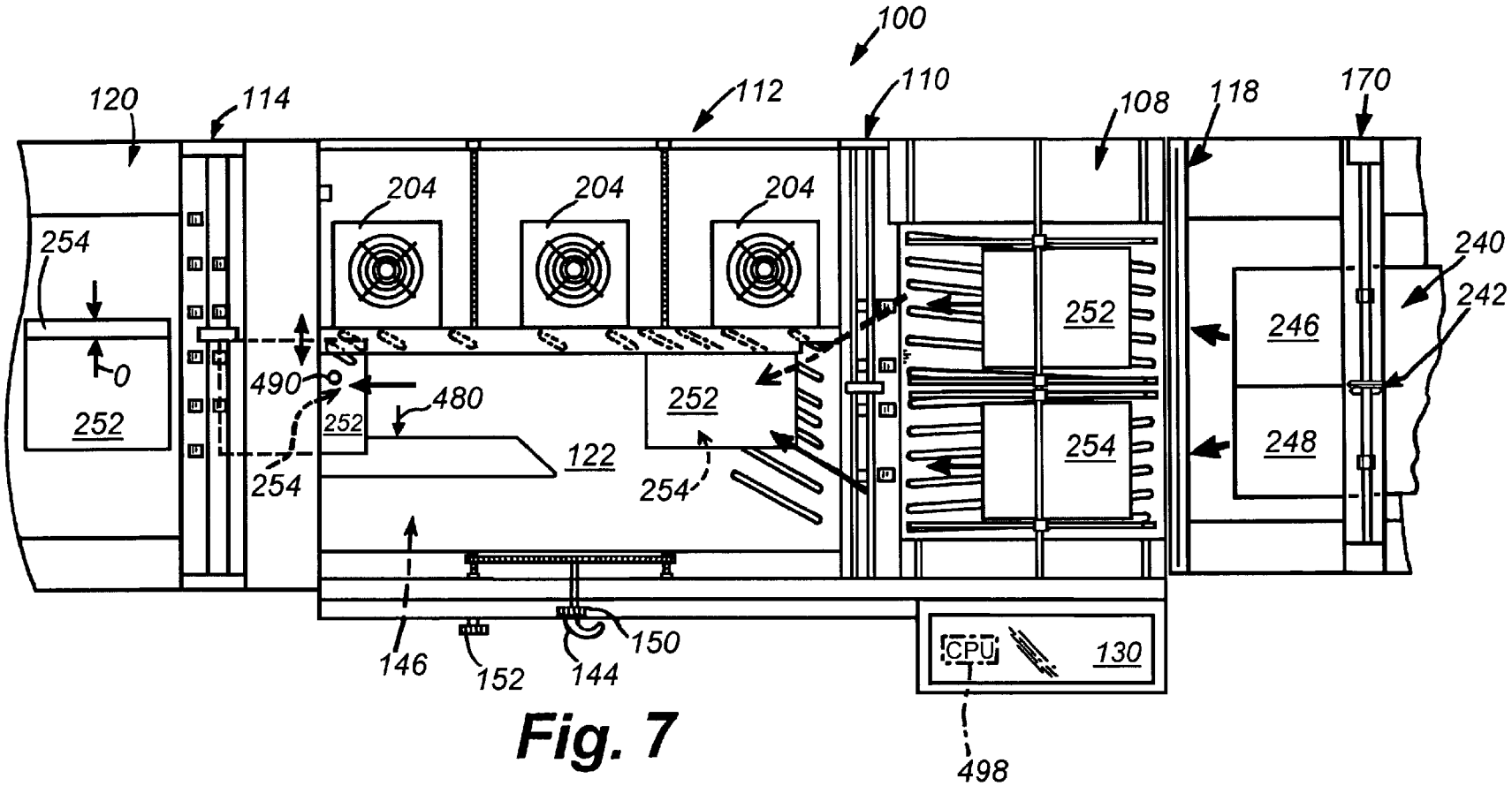
FIG. 7 is a plan view of the device configured to feed sheets into a merged relationship with an offset applied to a selected sheet by the top feed surface's moving edge guide.

FIG. 7 shows the merged mode as shown generally in FIG. 5, but also details an additional capability of the device according to a preferred embodiment. In this illustration, a pair of sheets 252 and 254 are provided on the upper and lower feed surfaces 122 and 146. The feed surfaces 112, 146 are sufficient in length to accommodate a plurality of standard length (11 or 14-inch, for example) sheets thereon. The edge guides 196 and 198 each include appropriate actuators (see exemplary actuator 470 in FIGS. 14–15) that enable the edge guide rail 472, 474 to move laterally for a predetermined distance. The offset distance is typically ¼ to ½ inch, but the actual distance can be widely varied. Actuators can be solenoid units, air cylinders, gear racks and pinions or any other acceptable linear drive unit. The vacuum belts enable lateral movement of sheets thereon with relatively low resistance due to the relatively low friction generated by the belts under vacuum. As such, lateral movement of the edge guide rail 472 or 474 causes ready lateral translation of sheets engaged thereby. In FIG. 7, the upper edge guide rail 196 has moved laterally inwardly (arrow 480 causing a corresponding movement of the upper sheet 252. If the edge guide rail 472 is translated laterally (arrow 480) as the sheet enters the rollers =of the output feed ramp 114, it will be captured in the particular lateral orientation in which it enters, the sheet remains offset as it passes into the output feed ramp 114. The resulting offset sheet 252 is spaced at a spacing 0 from the lower sheet 254. Note that the lower edge guide rail 474 also moves laterally, enabling lower sheets to be selectively offset. Sheets that are remote from the output feed ramp 114 are also offset by the rail 472. However, when the rail returns to a normal position the sheet is biased laterally to engage the rail in the normal position by the belts. Again, only as the sheet engages the output feed ramp 114 so that it can not move laterally, is at fixed in an offset or non-offset position owing to the firm frictional contact of the feed ramp rollers 380, 382, 384 and 386. A sensor 490 is provided adjacent the outlet of each feed surface to monitor when a sheet passes beyond the edge guide. Once a sheet clears the sensor, the edge guide can be moved to a different position without the risk of buckling or crumbling and exiting sheet. Likewise, an input sensor 492 is provided to determine when sheets are fully present upon the feed surface so that the edge guide is not moved while a sheet is still passing through the firm grip of the input diverter assembly 110. In other words, the edge guide on each feed surface only moves while sheets are fully thereon. The sheet throughput speed of the diverter 110 and output feed ramp unit 114 tends to be higher than that of the feed surfaces 122 and 146 so as to ensure that sheets enter and exit the feed surfaces quickly, thus allowing sheets on the feed surfaces sufficient time to be offset. A controller logic provided, for example, within the CPU 498 controls the timing of the offset and feed functions relative to readings taken by the sensors. The sensors can also act as jam detectors. In addition, other sensors can be provided on various motor drives and at desired points along the feed path to determine entry, exit and stoppage of sheets (among other parameters).

FIG. 12 illustrates an additional feature that can be provided adjacent the input feed unit 108, directly downstream of cutter 118 and slitter 170. A diverter gate 500 is shown in phantom. It can be moved (curved arrow 502) to create a gap in the feed path so that waste web 504 can drop into a waste bin 506. According to a basic procedure, the leading edge of a new web is driven for a predetermined length into the slitter 170. The initial portion of the web is essentially a leader section generally free of any usable printing. This leader section is used to thread the various printing and web utilization devices. The leader section is cut at selected locations by the cutter 118 and discarded into the bin 506 (by gravity drop) until desired printed sections are presented to the slitter and cutter. The diverter gate 500 is then closed and the web proceeds along the input feed surface 108 into the diverter ramp assembly 110 for streaming and/or merging. Note that at the moving diverter gate 500 as shown can be substituted with a variety of waste gate structures. A related error and waste diverter and tracking system is detailed in U.S. Pat. No. 5,628,574, entitled WEB ERROR RECOVERY DIVERT SYSTEM by H. W. Crowley. The teachings of this patent are expressly incorporated herein by reference.

The foregoing has been a detail description of a preferred embodiment of this invention. Various modifications and additions can be made without departing from the spirit and scope of the invention. For example, a variety of offset mechanisms can be employed including offset surfaces that move in whole or part. In addition, while angled belts are utilized for transport, perforated vacuum belts can be used, disks having ball positioned there over can also be used or other acceptable driving mechanisms that maintain sheets and registration with a predetermined edge can be employed. A variety of different sensor and speed control mechanisms can be utilized. The number of drive motors used can be varied and/or appropriate gearing can be provided between various moving elements of the unit. The various parts of the unit can be made in a modular fashion so that replacement of one or more modules can be readily accomplished. While sheets of a particular size and shape are shown (for example, 8 ½-inch width by 11 or 14-inch length), the device can be sized and arranged to handle a large variety of sheet sizes and shapes. Furthermore, while the upper feed surface is shown registering sheets against a right edge guide and the lower feed surface against an opposing left edge guide, the right and left registration pattern can be reversed (e.g. left on upper and right on lower). Accordingly, this description is meant to be taken only by way of example and not to other wise limit the scope of the invention.

What is claimed is:

1. An apparatus for selectively streaming and merging sheets comprising:

an input feed surface that transfers side-by-side sheets in a downstream direction;

a diverter assembly including side-by-side diverter ramps that are movable so as to selectively direct corresponding side-by-side sheets entering therein to from the input feed surface in each of an upward and a downward direction;

an upper feed surface for receiving sheets transferred in the upward direction from the diverter assembly;

a lower feed surface for receiving sheets transferred in the downward direction from the diverter assembly;

an upper edge guide on a first edge of the upper feed surface;

a lower edge guide on a second edge of the lower feed surface, the second edge being opposite the first edge as taken along widthwise direction transverse to the;

a feed assembly constructed and arranged to enable the upper feed surface and the lower feed surface to be moved in the widthwise direction so as to locate the upper edge guide at least two widths of one of the sheets away from the lower edge guide and to locate the upper edge guide approximately one width of the one of the sheets away from the lower edge guide to thereby enable sheets moving along each of the upper edge guide and the lower edge guide to be, respectively, maintained in a side-by-side streams or an overlapping merged orientation; and an output feed ramp for passing the sheets onto a common output surface from each of the upper feed surface and the lower feed surface in either an overlapping merged orientation or a streamed side-by-side orientation.

2. The apparatus as set forth in claim 1 wherein the upper feed surface and the lower feed surface each include drive members that generate angled force components for directing sheets from the diverter assembly from a widthwise position remote from upper edge guide and the lower edge guide, respectively, theretoward and downstream along the upper edge guide and the lower edge guide, respectively.

3. The apparatus as set forth in claim 2 wherein the drive members on each of the upper feed surface and the lower feed surface are located so as to receive and drive sheets transferred from each of the diverter ramps.

4. The apparatus as set forth in claim 3 wherein the drive members comprise elastomeric belts located in grooves, and having a vacuum suction passing therearound.

5. The apparatus as set forth in claim 3 wherein the diverter ramps comprise an upper guiding surface and a lower guiding surface joined at an apex adjacent the input feed surface, the apex being selectively movable about a pivot to direct sheets selectively along either of the upper guiding surface and the lower guiding surface.

6. The apparatus as set forth in claim 5 wherein the diverter assembly includes a an input nip roller assembly located upstream of and adjacent the apex and a pair of output nip roller assemblies located adjacent a respective downstream end of each of the upper guiding surface and the lower guiding surface.

7. The apparatus as set forth in claim 6 wherein each of the diverter ramps includes a control lever for independently rotating each of the diverter ramps about a pivot that is located downstream remote from the respective apex.

8. The apparatus as set forth in claim 1 wherein each of the diverter ramps includes a control lever for independently rotating each of the diverter ramps about a pivot that is located downstream remote from the respective apex.

9. The apparatus as set forth in claim 3 wherein each of the upper edge guide and the lower edge guide includes a moving offset rail that moves between an offset and a non-offset position for a predetermined distance in the widthwise direction so as to provide a widthwise offset to selected sheets engaged thereby.

10. The apparatus as set forth in claim 9 wherein the output feed ramp is constructed and arranged to maintain sheets in a widthwise position upon engagement therewith so as to maintain the selected widthwise offset.

11. The apparatus as set forth in claim 10 wherein the output feed ramp comprises a wedge-shaped feed surface having an upper guide surface that receives sheets from the upper feed surface and a lower guide surface that receives sheets from the lower feed surface, the upper feed surface and the lower feed surface converging at an apex located adjacent the common output surface.

12. The apparatus as set forth in claim 11 wherein the diverter assembly includes an upper input nip roller assembly adjacent the upper feed surface and a lower input nip roller assembly adjacent the lower feed surface and an output nip roller assembly downstream of the apex and upstream of the common output surface.

13. The apparatus as set forth in claim 12 wherein the common output surface is constructed and arranged to receive sheets from the diverter in each of an overlapping and side-by-side streamed orientation from the diverter assembly.

14. The apparatus as set forth in claim 3 wherein the lower feed surface is mounted on a pull-out drawer.

15. The apparatus as set forth in claim 3 further comprising jackscrews and interconnected adjustment knobs for translating each of the upper feed surface and the lower feed surface in the widthwise direction over a predetermined distance, respectively.

16. The apparatus as set forth in claim 3 further comprising a removable stream plate for covering predetermined of the drive members, on one of the upper feed surface and the lower feed surface, that are positioned remote from the upper edge guide and the lower edge guide, respectively, whereby sheets transferred from a diverter ramp approximately in-line with one of the upper edge guide and the lower edge guide are free of engagement by remote drive members.

17. The apparatus as set forth in claim 4 further comprising an upper enclosure housing that supports the upper feed surface and a lower enclosure housing that supports the lower feed surface, the upper enclosure housing and the lower enclosure housing, each of the upper enclosure housing and the lower enclosure housing including an upper fan assembly and a lower fan assembly, respectively, each for exhausting air from the upper housing enclosure and the lower enclosure housing, respectively, to thereby bias the air through the grooves.

18. The apparatus as set forth in claim 17 wherein the upper fan assembly includes ports for exhausting the air in an upward direction and the lower fan assembly includes ports for exhausting air in a downward direction.

19. The apparatus as set forth in claim 3 further comprising a cutter located upstream of the input feed surface for cutting sheets from a continuous web source feeding web to the cutter from an upstream location.

20. The apparatus as set forth in claim 19 further comprising a slitter located upstream of the input feed surface for dividing a single widthwise section of web from the source into side-by-side ribbons of web as taken along the widthwise direction.

21. The apparatus as set forth in claim 20 wherein the input feed surface comprises a pair of drive member sets each angled outwardly with respect to the other as taken in the downstream direction to thereby provide a separation between the side-by-side sheets as the side-by side sheets are received by the diverter assembly.

22. The apparatus as set forth in claim 21 wherein each of the drive member sets comprise a set of vacuum belts.

23. A method for feeding sheets comprising:

directing a first sheet and a second sheet, the first sheet and the second sheet being side-by-side, in a downstream direction into a diverter assembly having a first diverter ramp and a second diverter ramp, each of the first diverter ramp and the second diverter ramp being side-by-side and being selectively movable to each of the first sheet and the second sheet, respectively, to either of an upward location and a downward location;

providing an upper feed surface with an upper edge guide and a lower feed surface with a lower edge guide located opposite, in a widthwise direction, from the upper edge guide, the upper feed surface receiving sheets directed from the diverter assembly to the upward location and the lower feed surface receiving sheets directed from the diverter assembly to the downward location;

selectively locating the upper feed surface along the widthwise direction and locating the lower feed surface along the widthwise direction so as to position the upper edge guide and the lower edge guide one of either a single sheet width apart or at least two sheet widths apart;

moving the first diverter ramp to direct the first sheet to the upward location and the second diverter ramp to direct the second sheet to the downward location when the upper edge guide and the lower edge guide are positioned one sheet width apart to cause the first sheet and the second sheet to be merged;

moving the first diverter ramp to direct the first sheet to the downward location and the second diverter ramp to direct the second sheet to the upward location when the upper edge guide and the lower edge guide are positioned at least two sheet widths apart to cause the first sheet and the second sheet to be streamed; and directing the first sheet and the second sheet onto a common surface, whereby being one of either merged and streamed.

24. The method as set forth in claim 23 further comprising translating one of the upper edge guide and the lower edge guide in the widthwise direction to selectively offset one of the first sheet and the second sheet.

* * * * *